United States Patent [19]

Kern

[11] Patent Number: 4,882,076

[45] **Date of Patent: * Nov. 21, 1989**

[54] FABRIC SOFTENING AND ANTISTATIC PARTICULATE WASH CYCLE LAUNDRY ADDITIVE CONTAINING CATIONIC/ANIONIC SURFACTANT COMPLEX ON BENTONITE

[75] Inventor: Ronald D. Kern, Buttzville, N.J.

[73] Assignee: Colgate-Palmolive Co., Piscataway, N.J.

[ * ] Notice: The portion of the term of this patent subsequent to Nov. 22, 2005 has been disclaimed.

[21] Appl. No.: 253,012

[22] Filed: Oct. 4, 1988

Related U.S. Application Data

[63] Continuation of Ser. No. 916,068, Oct. 6, 1986, Pat. No. 4,786,422.

[51] Int. Cl.[4] ..... D06M 13/44

[52] U.S. Cl. ..... 252/8.8; 252/8.6; 252/174.25; 252/528

[58] Field of Search ..... 252/8.6, 8.8, 174.25, 252/528

[56] References Cited

U.S. PATENT DOCUMENTS

| | | | |
|---|---|---|---|
| 4,000,077 | 12/1976 | Wixon | 252/542 |
| 4,421,657 | 12/1983 | Allen et al. | 252/8.6 |
| 4,626,364 | 2/1986 | Bauman | 252/8.8 |
| 4,632,768 | 12/1986 | Atkinson | 252/8.6 |

*Primary Examiner*—Paul Lieberman
*Assistant Examiner*—John F. McNally
*Attorney, Agent, or Firm*—Bernard Lieberman; Murray M. Grill; Robert C. Sullivan

[57] ABSTRACT

A particulate agglomerate of cationic/anionic surfactant complex and bentonite is provided, for addition to the wash water in the wash cycle operation of automatic washing machines, to make washed and dried laundry softer to the touch and static-free, after rinsing and automatic tumble drying. Among the various advantages of the invention are increased stability of the cationic/anionic surfactant complex in such agglomerate from and during storage before use, the fabric softening effect of the bentonite, and the ready dispersion of the complex in the wash water, so that it does not deposit on the laundry as greasy stains of the type that are obtained when a sufficient antistatic and fabric softening proportion of cationic surfactant or an antistatic and fabric softening proportion of an essentially pure cationic/anionic surfactant complex is added to a control wash in which the wash water contains a detersive proportion of synthetic organic anionic detergent.

Also within the invention are processes for manufacturing the described agglomerate and for employing it together with a built synthetic organic anionic detergent composition in the washing machine to simultaneously wash and treat the laundry to make it soft and static-free.

18 Claims, 1 Drawing Sheet

Figure 1:
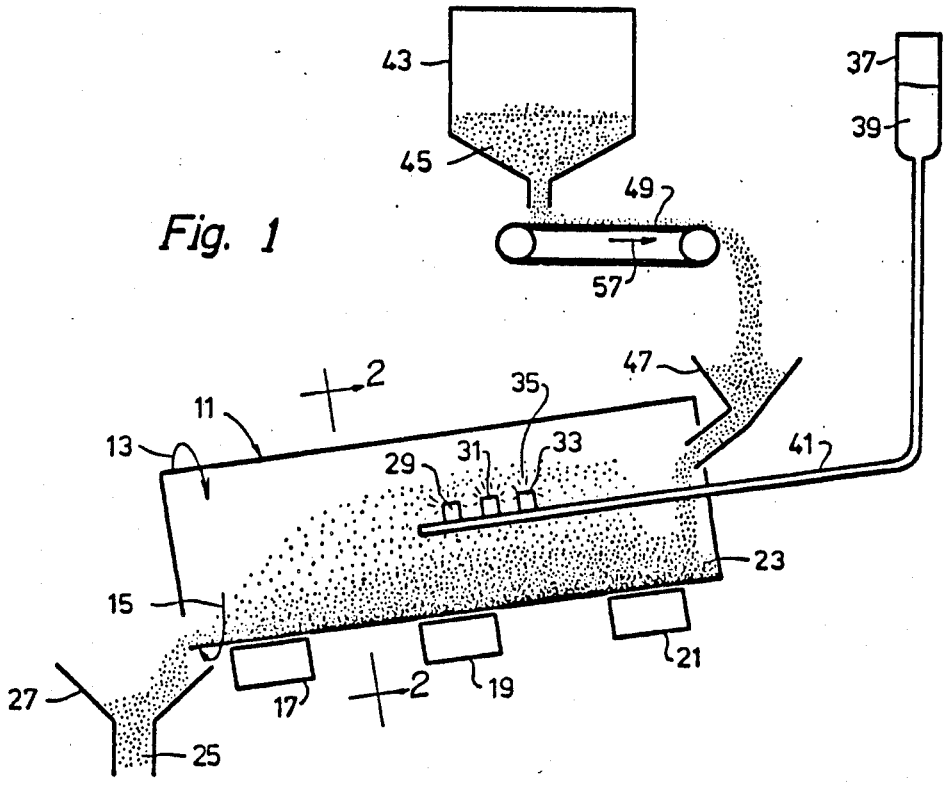

FABRIC SOFTENING AND ANTISTATIC PARTICULATE WASH CYCLE LAUNDRY ADDITIVE CONTAINING CATIONIC/ANIONIC SURFACTANT COMPLEX ON BENTONITE

This is a continuation of application Ser. No. 916,068 filed Oct. 6, 1986, now U.S. Pat. No. 4,786,422.

This invention relates to compositions which comprise a cationic/anionic surfactants complex and bentonite. More particularly, it relates to agglomerates of such complexes on bentonite, which are useful additives to the wash water in automatic washing machines to soften the fabrics of the laundry and to make such laundry antistatic, thereby preventing "static cling" even after tumble drying of such laundry in an automatic laundry dryer.

Various cationic surfactant (surface active) compounds have long been known and have long been employed to treat washed laundry to soften it and to diminish static effects, such as sparking and static cling. Because it was known that such compounds react adversely with anionic materials such as detergents, in wash waters, for many years such cationic surfactants were incorporated only in preparations intended for addition to rinse water. Because much laundry washing today is done by automatic washing machines, and such machines are not normally equipped with audible signals indicating the beginning of the rinse cycle, often the washing and rinsing would be completed and the addition of the cationic surfactant to the rinse water would have been unintentionally omitted. Also, even if the softenerantistat was added to the rinse, such addition would have required a special trip to the laundry room by the person doing the laundry. Thus, it was considered highly desirable to be able to have a means or preparation for adding cationic surfactant, such as quaternary ammonium salt or imidazolinium salt, in the wash cycle, together with the detergent composition. However, such addition resulted in the reaction, by ionic bonding, of the cationic surfactant with various materials in the wash water, such as with anionic detergent to produce a waxy water insoluble reaction product, with anionic fluorescent brighteners and with color anions from the tap water, which reaction products could then deposit on the laundry. Due to such ionic bonding reactions detergency would be decreased, as would be fluorescent brightening of the laundry, and greasy deposits of the reaction product on the laundry could appear colored (usually yellowed).

Despite the disadvantages of the use of cationic fabric softening and antistatic surfactants in the wash cycle in conjunction with anionic detergents, anionic detergent compositions have been made which contained such cationic surfactants. Such products require the employment of additional anionic detergent and fluorescent brightener (to make up for such compounds which reacted with the cationic surfactant), and deposits of greasy reaction product on the laundry would still occur. However, in the present invention, wherein such anionic/cationic surfactant complexes are intentionally made and are then compounded with bentonite, very preferably as an agglomerate with finely divided bentonite powder, and are added to the wash cycle water as such agglomerate, the cationic/anionic surfactant complex, being already formed, does not further react with anionic detergent, fluorescent brightener, anionic color bodies or other anionic materials in the wash water, the agglomerated complex does not additionally agglomerate or expand, and yet the finely divided complex effectively deposits, in finely divided form, on the laundry to soften it and effectively to diminish static cling of laundered items, which static effect is often observed when the laundry washed is made up in whole or in part of fabrics of synthetic polymeric fibers, and is subjected to automatic tumble drying after washing and rinsing.

In accordance with the present invention a fabric softening and antistatic particulate wash cycle additive, for use in conjunction with anionic detergent(s) in the wash water of automatic washing machines, to wash, soften and render antistatic laundry washed in such machines and subsequently dried in an automatic laundry dryer, comprises about 10 parts by weight of a complex of a cationic surfactant and an anionic surfactant, in which complex the molar proportion of cationic moiety to anionic moiety is in the range of about 1:1 to 1:1.5, and 1 to 80 parts by weight of bentonite, said complex being in a coating on said bentonite particles, with the particle sizes of the combined particles being less than 250 microns in diameter. In preferred embodiments of the invention the anionic surfactant is an anionic detergent of the sulfonate, sulfate or carboxylate type, which includes a lipophilic moiety, or a mixture of such detergents, the cationic surfactant is a quaternary ammonium salt or an imidazolinium salt, or a mixture thereof, the agglomerate is of particle sizes in the range of 105 to 210 microns, the bentonite thereof is of particle sizes in the range of 37 to 74 microns, and the proportion of complex to bentonite is ten parts by weight of complex to 3 to 15 parts by weight of bentonite. Also within the invention are processes for manufacturing such bentonite-complex agglomerate compositions and for employing them in the wash cycle of an automatic washing machine, together with a built synthetic anionic organic detergent composition.

Searches of available prior art and of other records have resulted in the findings of U.S. Pat. No. 4,000,077 (hereby incorporated by reference) and 4,062,647. U.S. Pat. No. 4,000,077 discloses a textile softening composition which contains as essential components a cationic fabric softener, such as an imidazolinium salt, and a minor amount of a higher aliphatic alcohol sulfate. This patent discloses various imidazolinium salts and higher aliphatic alcohol sulfates, together with procedures for reacting them. The patent teaches that the described softening compositions could be made in liquid or particulate form, adsorbed onto a carrier, but employment thereof was only in the rinse water. U.S. Pat. No. 4,062,647 describes built detergent compositions containing bentonite and other smectite clays, which are said to be useful as fabric softening and antistatic agents. It is evident that neither of these publications anticipates the present invention or makes it obvious. The '077 patent does not describe the use of the complex thereof in a wash water additive and although it mentions employing the complex on a particulate carrier, bentonite is not disclosed as such carrier. The '647 patent does not disclose applicant's complexes and does not disclose or suggest employment of such a complex with bentonite as a wash water additive for use with built synthetic organic anionic detergent compositions. Furthermore, the combinations of patents would not suggest to one of skill in the art the special advantages obtained from applicant's agglomerates. Other patents known to applicant relate to complexes of bentonite and amines and/or quaternary ammonium moieties in detergent compositions but are not considered to be particularly relevant because they do not disclose the use of applicant's complexes.

Applications of the inventor's co-workers, James M. Thomas (with him) and Dean G. Klewsaat, entitled Permeable Pouch Article Containing Fabric Softening and Antistatic Cationic and Anionic Surfactants or Complex Thereof, and Cationic/Anionic Surfactant Complex Antistatic and Fabric Softening Emulsion for Wash Cycle Laundry Applications, respectively, and filed in the U.S. Patent and Trademark Office on the same day as the present application, are considered to be of interest, and therefore are mentioned herein. The former relates to a fabric softening and antistatic article comprising anionic and cationic surfactants, or a complex thereof, like those of the present invention, in a filtering pouch, intended for addition to wash water, containing anionic detergent, and the latter is for a fabric softening antistatic agent which is a complex similar to those of the present invention, and which is in aqueous emulsion form.

The cationic surfactant employed may be any suitable cationic surfactant which has either fabric softening or antistatic properties, or both. Primarily, those cationic materials which are most useful are what will be referred to as quaternary ammonium salts, which are those wherein at least one higher molecular weight group and two or three lower molecular weight groups are linked to a common nitrogen atom to produce a cation and wherein the electrically balancing anion is a halide, acetate or lower alkosulfate ion, such as chloride or methosulfate. The higher molecular weight substituent on the nitrogen is preferably a higher alkyl group, containing 12 to 18 or 20 carbon atoms, such as cocoalkyl, tallowalkyl, hydrogenated tallowalkyl or substituted higher alkyl, and the lower molecular weight substituents are preferably lower alkyls of 1 to 4 carbon atoms, such as methyl or ethyl, or substituted lower alkyls. One or more of said lower molecular weight substitutents may include an aryl moiety or may be replaced by an aryl, such as benzyl, phenyl or other suitable substituent. A preferred quaternary ammonium salt is a dihigher alkyl, di-lower alkyl ammonium halide, such as di-tallowalkyl dimethyl ammonium chloride or di-hydrogenated tallowalkyl dimethyl ammonium chloride, (which may be called distearyl dimethyl ammonium chloride), and other quaternary ammonium chlorides will also usually be preferred.

In addition to the cationic compounds previously mentioned, other suitable cationic surfactants include the imidazolinium salts, such as 2-heptadecyl-1-methyl-1-[(2-stearoylamido) ethyl]-imidazolinium chloride; the corresponding methyl sulfate compound; 2-methyl-1-(2-hydroxyethyl)-1-benzyl imidazolinium chloride; 2-coco-1-(2-hydroxyethyl)1-benzyl imidazolinium chloride; 2-coco-1-(2-hydroxyethyl)-1-octadecenyl imidazolinium chloride; 2-heptadecenyl-1-(2-hydroxyethyl)-1-(4-chlorobutyl) imidazolinium chloride; and 2-heptadecyl-1-(hydroxyethyl)-1-octadecyl imidazolinium ethyl sulfate. Generally, the imidazolinium salts of preference will be halides (preferably chlorides) and lower alkylsulfates (alkosulfates).

Others of the mentioned quaternary ammonium salts and imidazolinium salts having fabric softening and/or antistatic properties may also be employed in the present invention and various examples of such compounds are given in U.S. Pat. No. 4,000,077.

The anionic surfactant which may be employed to form complexes employed in the manufacture of the compositions of this invention may be any suitable anionic surface active agent, including those utilized for their detersive, wetting or emulsifying powers, but normally these will preferably be anionic detergents. Such detergents will include a lipophilic anionic moiety of relatively high molecular weight, which lipophile will preferably be or include a long chain alkyl or alkenyl group of at least 12 carbon atoms, such as of 12 to 18 carbon atoms. Such lipophilic moiety will usually include a sulfonic, sulfuric or carboxylic group so that when neutralized there will be produced a sulfonate, sulfate or carboxylate, with the cation preferably being an alkali metal, ammonium or alkanolamine, such as triethanolamine. The higher alkyls of such surfactants may be from 10 to 20 carbon atoms but normally will be of 12 to 18 carbon atoms, and in the present invention will preferably be of 12 to 16 carbon atoms. Examples of such anionic surfactants include sodium dodecylbenzene sulfonate, sodium linear tridecylbenzene sulfonate, potassium octadecylbenzene sulfonate, sodium lauryl sulfate, triethanolamine lauryl sulfate, sodium palmityl sulfate, sodium cocoalkyl sulfate, sodium tallowalkyl sulfate, sodium ethoxylated higher fatty alcohol sulfate of 1 to 30 ethylene oxide groups per mole, such as sodium monoethoxy octadecanol sulfate and sodium decaethoxy cocoalkyl sulfate, sodium paraffin sulfonate, sodium olefin sulfonate (of 10 to 20 carbon atoms in the olefin), sodium cocomonoglyceride sulfate, sodium coco-tallow soap (1:4 coco:tallow ratio), and sodium coco soap. Preferred anionic detergents for complexing with the cationic surfactants are the higher alkylbenzene sulfonates, the higher fatty alcohol sulfates, and the ethoxylated higher fatty alcohol sulfates, in which the salt forming cation is preferably alkali metal, more preferably sodium.

The bentonite employed may be any suitable bentonite but very preferably will be a swelling bentonite. It will normally be utilized in finely powdered form, with all or substantially all (over 95%) passing through a No. 200 sieve, U.S. Sieve Series, and it will often be even more preferable to have the bentonite more finely divided, so that all or substantially all of it passes through a No. 325 sieve, too. It is considered that a particle which measures 74 microns in minor diameters will just pass through a No. 200 sieve and that a particle which measures 44 microns, in minor diameters, will just pass through a No. 325 sieve. Generally it will be undesirable to have the bentonite smaller in particle size than that which will just pass through a No. 400 sieve (37 microns in diameter) so a highly preferred bentonite is one of particle sizes substantially all (at least 95% by weight) of which are in the range of 37 to 74 microns in minor diameters, but when 90% by weight of the particles are in such range the bentonite will also be very useful.

While it is preferred to employ swelling bentonites of the type known as Wyoming bentonite, other bentonites may also be utilized, including those mined in Canada, Italy, Spain, U.S.S.R. and in states of the United States other than Wyoming (principally Idaho, Mississippi and Texas). The bentonites preferably employed are sodium or potassium bentonites and are mined as such. However, bentonites of low or neglible swelling capacities may be converted or activated to increase such capacity by treatment with alkaline materials, such as aqueous sodium carbonate solution, in a manner known in the art. Mixtures of swelling and non-swelling bentonites may be employed but it is considered that the more non-swelling bentonite that is present the less effective is the fabric softening activity.

Among various suppliers of satisfactory bentonites are American Colloid Corporation and Georgia Kaolin Company. A product of Georgia Kaolin Company that has been found to be satisfactory is their Mineral Colloid No. 101, formerly sold as Thixogel No. 1. American Colloid Corporation supplies a bentonite clay designated AEG 325, which is equally acceptable. In Italy suitable activated clay is marketed as Laviosa AGB and in the Philippines a bentonite clay sold under the tradename Filgel is useful in the practice of this invention.

The molar proportion of cationic moiety to anionic moiety in the cationic/anionic complexes will normally be in the range of 1:1 to 1:1.5, preferably being about 1:1 and more preferably being equimolar. Thus, because both the anionic and cationic moieties are usually monovalent, the stoichiometric ratio will be an equimolar ratio to produce the desired complex, without any excess of either cationic or anionic surfactant.

The cationic/anionic complex and the bentonite powder may be blended to form a particulate wash cycle additive composition, and such a composition can have some useful fabric softening and antistatic effects. However, it will normally be preferred that the complex be in the form of a coating or partial coating on the bentonite particles and more preferably the complex will assist in binding the bentonite particles into desirably sized agglomerates. Such agglomerates will usually be of particle sizes less than 250 microns in diameter, so that they will pass through a No. 60 sieve. Preferably, the agglomerates will be less than 210 microns in minor diameters, passing through a No. 70 sieve, and more preferably, the range of particle sizes of the agglomerates will be 105 to 210 microns, between No's. 140 and 70 sieves. Most preferably, the agglomerates will be of such particle sizes that substantially all (95% by weight) will pass through a No. 80 sieve (177 microns).

The ratio of complex to bentonite will be ten parts by weight of complex to 1 to 80 parts by weight of bentonite, with 2 to 30 parts by weight of bentonite being preferred, 3 to 15 parts of bentonite being more preferred and 8 to 12 parts being most preferred, all with ten parts of complex.

Because in one aspect of the invention the complex-bentonite composition may be made by mixing an emulsion of complex with bentonite, preferably to agglomerate the bentonite to particle sizes such as those previously mentioned, the composition or agglomerate made may include an emulsifying agent. Such may be any suitable emulsifier, capable of emulsifying the cationic-/anionic surfactant complex to produce a suitable emulsion or dispersion for spraying onto the surfaces of the bentonite particles. Preferred emsulsifying agents are those which are surface active and of these the more preferred are the ethoxylated higher alkylamines, the ethoxylated higher alcohols and the ethoxylated higher alkyl amine/higher fatty acid complexes. Such amines will normally be of 12 to 18 carbon atoms in the alkyls thereof and of 10 to 50 moles of ethylene oxide per mole. The higher fatty acid complexes thereof are preferably stearic acid complexes, such as the stearic acid complexes of tallow-alkyl ethoxylated amines. The mentioned ethoxylated amines are sold as as Ethomeens® or as TAM-15, TAM-20 and TAM-40, by Emery Industries. Also useful emulsifiers are the condensation products of ethylene oxide with fatty alcohols, such as those wherein the higher fatty alcohol is of an average of 12 to 18 carbon atoms, preferably 12 to 15 carbon atoms, and which include 3 to 20 moles of ethylene oxide per mole of alcohol. Among such materials the preferred emulsifier is that sold as Neodol® 25-7, by Shell Chemical Company.

When an emulsifier is present with the complex the final wash cycle additive of this invention will include emulsifier, too. The proportion thereof present will usually be from 0.5 to 10 parts per 10 parts of complex, preferably being from 2 to 5 parts per 10 parts of complex.

In addition to an emulsifier or emulsifier mixture, the invented compositions may include various adjuvants, such as colorants, perfumes, antibacterial agents, enzymes and pigments, as may be desired, usually constituting a total of less than two parts per ten parts of complex. However, normally only perfume and colorant will be present.

Figure 2:
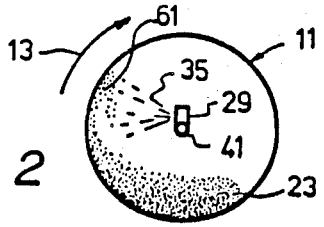

The compositions of this invention may be manufactured by mixing bentonite powder and spraying onto the surfaces thereof, while continuing mixing, a melt, solution, emulsion or dispersion of the complex of cationic and anionic surfactants, and continuing mixing thereafter until a satisfactory mixture of the complex and bentonite is obtained, preferably as an agglomerate in which the particle sizes are less than 250 microns. Although the complex may be heated to liquefy it and the melted complex may be sprayed onto the mixing bentonite, and although the complex may be in the form of a fine dispersion in a continuous phase of liquid, it is considered to be preferable to employ a solution or emulsion of the complex, preferably in aqueous media, and to spray such onto the moving surfaces of the bentonite powder. Various types of continuous and batch apparatuses may be employed for the desired agglomeration of the complex and bentonite but often it will be preferred to utilize an inclined drum or tube type continuous agglomerating mixer. The manufacturing processes of this invention will be readily understood from the present specification, taken in conjunction with the accompanying drawing, in which:

FIG. 1 is a somewhat schematic representation of an inclined drum agglomerator apparatus of this invention, including auxiliary apparatuses, in elevational view; and FIG. 2 is a sectional view along plane 2—2 of FIG. 1, showing the spraying of the liquid state complex onto a falling curtain of bentonite particles.

In FIG. 1 hopper 43 containing bentonite 45, feeds such bentonite to conveyer belt 49, the top supporting surface of which is moving in the direction of arrow 57, so that the bentonite is fed into trough 47 from which it flows into rotating inclined drum 11, which is rotating in the direction indicated by arrows 13 and 15. Agglomerating drum 11 is supporting by and rotated by movements of rollers 17, 19 and 21. The bentonite entering the agglomerating drum forms a bed 23 thereof in the drum and, because of the direction of rotation of the drum, some of the bentonite particles are carried up a wall thereof and fall down from it, due to gravity, forming a curtain 61 (FIG. 2) onto which the complex, in liquid state, preferably as a suitable aqueous or alcoholic solution or emulsion, is directed, in a spray 35. The liquid state complex 39, in container 37, is fed through delivery tube 41 to spray nozzles 29, 31 and 33, from which it is emitted as spray 35.

After contacting of the complex and the bentonite, the bentonite particles, with complex held to them, continue to be mixed in the lower ½ or ⅓ of the tumbling drum, in which section agglomeration continues to occur, until the desired agglomerate size is reached. The size of the agglomerate may be regulated by modifying the temperature or concentration of the complex, the nature of the spray, the spray rate, the rotational speed of the agglomerator, and the temperature in the agglomerating portion of the drum. The desired agglomerate 25 is removed from the drum via hopper 27 and, if desirable, it is dried (and/or solvent is removed) so that it is free of solvent and of a moisture content of no more than 10%, in most instances, and, if considered desirable, it is screened or otherwise size classified to remove fines and/or coarse particles, so that the agglomerate will be of desired particle size range characteristics.

In a preferred process for making the agglomerated wash cycle additive of this invention the complex is sprayed onto the bentonite in aqueous solution or emulsion form, sometimes at elevated temperature, e.g., in the range of 40 to 70° C., and the anionic surfactant of the complex is a sulfonate, sulfate or carboxylate, or a mixture thereof. More preferably if the agglomerate contains 10% or more of moisture, it is dried to a moisture content less than 10%, such as in the range of 1 to 5%, and if the agglomerate contains oversized and/or undersized particles such are removed by screening or other size classification means.

In the use of the invention laundry is simultaneously washed and treated to soften it and make it antistatic by agitating the laundry in wash water at a temperature in the range of 30 to 95° C., preferably 30 to 60° C., and more preferably 35 to 50° C., as in the wash cycle of and automatic washing machine, with a built synthetic organic anionic detergent composition which is present in the wash water at a concentration in the range of 0.05 to 0.5%, preferably 0.1 to 0.2%, e.g., 0.13% or 0.15%, in the presence of 0.01 to 0.1%, preferably 0.01 to 0.04%, e.g., 0.02 or 0.03%,of the particulate agglomerated wash cycle additive, in the wash water, rinsing the washed laundry, and drying it. Normally, the washing and rinsing will be effected in an automatic washing machine, using normal washing and rinsing cycles, and the drying will be carried out in an automatic laundry dryer, in which the laundry is tumbled while hot air is blown through it during the drying operation.

The detergent composition employed in the wash cycle comprises 5 to 35% of synthetic anionic organic detergent, 10 to 80% of builder for such anionic detergent and 0 to 50% of filler salt. Preferably the synthetic anionic organic detergent of the detergent composition is a lipophile sulf(on)ate (sulfate or sulfonate) and is selected from the group consisting of higher fatty alcohol sulfates, higher alkylbenzene sulfonates, sulfated ethoxylated higher fatty alcohols, olefin sulfonates, paraffin sulfonates, monoglyceride sulfates, and mixtures thereof, the builder is selected from the group consisting of polyphosphates, carbonates, bicarbonates, borates, silicates, zeolites and mixtures thereof, and the filler salt is sodium sulfate. More preferably the synthetic organic anionic detergent is sodium linear higher alkylbenzene sulfonate, sodium higher fatty alcohol sulfate, sodium higher fatty alcohol ethoxylate sulfate or a mixture thereof, the builder is sodium tripolyphosphate, sodium pyrophosphate, sodium carbonate, sodium bicarbonate, sodium silicate, sodium borate, or a mixture thereof, and the proportions of synthetic organic anionic detergent, builder and filler salt are in the ranges of 15 to 30%, 25 to 70% and 0 to 40%, respectively. For example, with respect to the surfactants, sodium linear tridecylbenzene sulfonate and dihydrogenated tallowalkyl dimethyl ammonium chloride are often the most preferred reactants. The agglomerates employed with the built anionic detergent compositions are those previously described, so it is not considered that a repetition of such description is required herein.

The advantages of the present invention, in its composition, agglomerate, manufacturing process and washing embodiments, compared to prior art products and processes, are many and are considered to be highly significant. First, although complexes like those employed herein were previously made, they were not used in wash cycle treatment of the laundry. Thus, the person doing the laundry had to make a special trip to the washing machine in the laundry room to add fabric softener/antistat to the rinse water. Even if one were to employ the complex in the wash cycle, merely adding the complex would often have resulted in unsatisfactory treatment of the laundry because the complex would coalesce and form greasy deposits on the laundry. If, as U.S. Pat. No. 4,000,077 might be considered to suggest, one had mixed the complex with particulate carrier material, such as builders, clays or zeolites, the alkaline builders could have chemically reacted with the complex on storage before use, the zeolites could have reacted with components in the wash water to produce chalky deposits on the laundry(by reacting with silicate) and the clays could have been dusty, which would have been unacceptable for retail marketing. By employing bentonite with the complex and by forming size controlled agglomerates of the complex and bentonite the present desirable effects were obtained. The bentonite is covered with the complex, which complex binds the bentonite particles together, but the bentonite also assists in such binding and promotes the production of a readily flowable product. When the agglomerate is added to the wash water the bentonite virtually "explodes", thereby rapidly dispersing the complex in the wash water where it can be quickly contacted by the agitated laundry, to which it adheres. The bentonite also adheres to the laundry and adds to the laundry its fabric softening properties, as well as any antistatic properties it may possess. If the bentonite did not cause rapid dispersion of the complex in the wash water the complex could coalesce to form larger micelles or conglomerates, which could cause greasy stains or smears to appear on the laundry. However, the bentonite prevents any such coalescence during storage before use and in the wash water, and by adhering to the laundry too, it separates adhering small deposits of complex and prevents coalescence of the complex and staining and smearing of it on the laundry fabrics, and it also adds its own fabric softening action to the described agglomerates. Among additional advantages of the invention are the fabric softening and antistatic effect due to the presence of the ethoxylated amine emulsifier, which, while functioning as an emulsifier, also adds to the fabric softening and antistatic properties of the invented compositions. Similar effects are attributed to the higher fatty acid complexes of such ethoxylated amine emulsifiers, and to other compounds of similar structures.

The following examples illustrate but do not limit the invention. Unless otherwise indicated, all parts and percentages in the examples, specification and claims are by weight and all temperatures are in °C.

EXAMPLE 1

(Manufacture of Cationic/Anionic Complex)

A molar proportion of di-hydrogenated tallowalkyl dimethyl ammonium chloride (572 g./mole) and a molar proportion of sodium tridecylbenzene sulfonate (362 g./mole) are reacted to form a cationic/anionic complex employed in this invention. First, the quaternary ammonium salt described is heated to a temperature of about 65° C., at which it melts. Subsequently, while continuing to heat the quaternary salt melt, the mentioned anionic surfactant is slowly added to it, with stirring. The heat is then increased (stepwise) to 160° C. and during such heating any water and solvent which may be present are driven off. The hot complex resulting is carefully transferred to another container by decantation, so that the precipitate of sodium chloride byproduct is retained in the first container. The purified complex made is then allowed to cool to room temperature.

In a modification of this process instead of employing pure cationic and anionic surfactants, commercial sources of them are utilized, Arquad® 2HT-75, and sodium linear tridecylbenzene sulfonate, in slurry form, which is normally employed for the manufacture of commercial spray dried built synthetic organic anionic detergent compositions. The Arquad 2HT-75 is 75% active and the anionic surfactant slurry is 48% active so there are employed 1.01 parts by weight of the Arquad 2HT-75 for every part by weight of the sodium linear tridecylbenzene sulfonate slurry. Using the commercial materials, rather than those which are 100% active, results in a longer heating time to the 160° C. temperature, due to driving off more water (from the anionic surfactant slurry) and solvent (from the Arquad 2HT-75), and more precipitate is obtained from the reaction, but after decantation the complexes produced are essentially equivalent.

In a manner like those described above other complexes are made by employing molar proportions (on an active ingredient [A.I.]basis) of sodium monoethoxy dodecyl sulfate, sodium lauryl sulfate, and sodium cocate (sodium soap of coco fatty acids). Furthermore, additional complexes are made by utilizing the mentioned anionic surfactants and reacting them separately, in equimolar proportions, with di-$C_{12-18}$ alkyl dimethyl ammonium bromide, distearyl dimethyl ammonium chloride, fatty amido alkyl ammonium chloride (Culversoft®WS), methyl tallow-alkyl amido ethyl alkyl imidazolinium methosulfate (Varisoft® 475) and dimethyl dicocoalkyl ammonium chloride (Adogen® 462). Substantially the same manufacturing process is employed and the complexes that are obtained are suitable for incorporation in the invented particulate agglomerated complex/bentonite wash cycle fabric softening and antistatic emulsions of the present invention. All the complexes are solids at room temperatures and are waxy, greasy, or oily in appearance, whether they are pure complexes or mixtures of complexes. The following are a representative few of the complexes made: ditallowalkyl dimethyl ammonium lauryl sulfate; distearyl dimethyl ammonium tallow alcohol sulfate; di-$C_{12-18}$ dimethyl ammonium tridecylbenzene sulfonate; and methyl tallowamido ethyl tallow imidazolinium lauryl sulfate.

EXAMPLE 2

(Manufacture of Complex/Bentonite Agglomerates)

The complex of di-hydrogenated tallowalkyl dimethyl ammonium chloride and sodium tridecylbenzene sulfonate (dihydrogenated tallowalkyl dimethyl ammonium tridecylbenzene sulfonate) of Example 1,in finely divided form, is made into a composition like the agglomerates of this invention by being blended with bentonite powder, using an inclined drum mixer. Such "control" composition is made by blending equal parts by weight of the complex and a swelling Wyoming sodium bentonite, in powder form, of particle sizes substantially all (over 95%) passing through a No. 200 sieve and resting on a No. 400 sieve, U.S. Sieve Series. The mix is made by using the apparatuses illustrated in FIGS. 1 and 2, with the bentonite powder being conveyed from bin 43 to drum 11 and with the complex, in discrete particle form (it may be ground to such form when cold) being fed from a similar bin onto another conveyer, not illustrated, which also delivers its material to inclined drum 11 through feed trough or hopper 47. In this process no material is sprayed onto the tumbling mixture. The product obtained is of particle sizes less than 250 microns in diameter and more than 37 microns in diameter (at least 95% in that range).

An agglomerate of this invention is made, using the apparatus illustrated in FIGS. 1 and 2, from the same complex as previously mentioned in this example, and the same bentonite but the complex is in molten state, at a temperature of about 85° C., when sprayed in finely divided globular form, of spray droplet sizes similar to those of the bentonite, onto the tumbling bentonite powder. Mixing is continued for approximately five minutes after the spraying of bentonite, in which additional "curing" time the agglomerates formed are rounded to produce substantially globular particles, the particle sizes of which are substantially in the range of 105 to 210 microns. Any undersized or oversized particles (outside the described range) are removed by screening or other suitable classification technique. In similar manners, agglomerates of the same type and characteristics are made by utilizing a hot (85° C.) aqueous suspension of the complex (one part by weight of complex to two parts by weight of water), an alcoholic solution of the complex at room temperature (one part by weight of complex to three parts by weight of alcohol) and an emulsion of complex in water at room temperature (one part by weight of complex, 0.5 part by weight of Neodol 25-7 [nonionic surfactant condensation product of higher fatty alcohol averaging 12 to 15 carbon atoms per mole, and seven moles of ethylene oxide]and three parts by weight of deionized water). After formation of the desired agglomerate excess water (if any) is removed by heat and air drying so that the moisture content is reduced to about 5%. Any alcohol present is entirely volatilized off and is recovered for reuse. The agglomerates made are like that described above in this example.

In variations of these experiments the procedures are repeated, utilizing other cationic/anionic surfactant complexes, including di-tallowalkyl dimethyl ammonium lauryl sulfate, distearyl dimethyl ammonium tallow alcohol sulfate, di-$C_{12-18}$ alkyl dimethyl ammonium dodecylbenzene sulfonate and methyl tallowalkylamido ethyl tallow imidazolinium lauryl sulfate. Also, in the emulsion of complex that is employed, the emulsifier may be replaced by tallowalkyl amine ethoxylates, such as Ethomeens®, TAM-8, TAM-15, TAM-20 and TAM-40, either in whole or in part, e.g., 50% replacement. The various agglomerated products that are formed are physically and chemically stable on storage, not disintegrating and not being decreased in particle size to a significant extent, with tests of the complex indicating that it does not lose its fabric softening and antistatic effects by being agglomerated with the bentonite. The agglomerates are free flowing and are not unattactive in appearance, which characteristics are important for the intended use as a wash cycle additive intended for retail sale and household use.

EXAMPLE 3

(Washings of Fabrics, and Comparative Results)

The particulate wash cycle additives described in Example 2 are employed in tests of their efficacies as fabric softening and antistatic additives in wash waters utilizing automatic washing machines with low hardness wash waters at a temperature of about 39° C., which "warm" washing is considered to be a severe, yet practical test of detergent compositions and auxiliary or adjuvant compositions and components thereof. The amounts of particulate detergents and wash waters employed are 85 grams and 64 liters, respectively, for a full size, top loading, home laundry automatic washer. If desired, liquid detergents can be employed instead of the particulate products. Also, nonionic detergent compositions can be used but the decided advantages of the present additives are most significant when the detergent used is anionic [preferably built with inorganic builder salt(s)]. The amount of the wash cycle additive that is added to the wash water is 13 grams, and may be measured out with a dispensing measuring cap, or may be pre-packaged. In the washings there is utilized tap water which is of a mixed calcium and magnesium hardness of about 100 parts per million p.p.m.). The detergent employed is a commercial built synthetic organic anionic detergent composition containing approximately 4% of sodium linear dodecylbenzene sulfonate, 12% of sodium higher (12 to 15 carbon atoms) fatty alcohol ethoxylate (1 to 3 ethoxy groups per mole), 35% of sodium tripolyphosphate, 5% of sodium silicate, 25% of sodium sulfate, 5% of water, and the balance of various functional adjuvants. This product is sold commercially as TIDE®. The wash load includes five each of swatches of cotton percale, 65% Dacron®/ 35% cotton, Dacron double knit, Dacron single knit, Banlon® nylon, acetate jersey and nylon tricot, all of which swatches measure 36×38 cm. The synthetic and synthetic blend swatches of such wash load are useful for evaluating static accumulations after tumble drying in an automatic laundry dryer. Also present in the washing machine are four cotton wash cloths (of terrycloth), useful for evaluating softening effects, and Soil Removal Index swatches of several different textile materials, stained with different "difficult" stain materials, including three swatches each of: Testfabrics nylon and cotton materials, each stained with an oily soil/particulate stain; clay on cotton; clay on 65% Dacron / 35% cotton blend; and EMPA 101 (oily soil/particulate stain). The wash water is added first to the wash tub of the machine, followed by detergent and particulate cationic/anionic complex/bentonite additive, and such materials are mixed in the wash tub for about a minute, using wash cycle agitation, after which the wash load swatches, the cotton wash cloths and the Soil Removal Index (SRI) swatches are added and a ten minute regular wash cycle is begun. Washing is followed by conventional automatic rinsing and after completion of the rinsing and extracting cycles the various test materials and wash load materials are transferred to an automatic laundry dryer, in which they are dried for an hour.

Tests like those described previously in this example are run, using the same amounts of the cationic surfactants as are present in the particulate additives, and in other comparisons, employing the equivalents of the cationic/anionic complexes, without bentonite. Otherwise, the test conditions are the same.

The complex/bentonite agglomerates all appreciably soften the test swatches (and laundry) washed, make them antistatic, and do not objectionably decrease detergency or deposit unsightly greasy stains on the washed items. The washes with the cationic surfactants charged directly thereto are not as effective in softening or inhibiting accumulations of static charges, and detergency is noticeably adversely affected. When color bodies and fluorescent brighteners are in the wash water, color body staining is worse with the controls than with the invented compositions (no discoloration with the invented products) and loss of fluorescent brightening effects are noted with the controls but not with the invented compositions. Like results obtain in respect to grease spotting of the washed swatches when the controls are cationic/anionic surfactant complexes instead of the cationic softeners. Thus, the invented agglomerates and washing processes are superior to prior art products and processes.

EXAMPLE 4

(Experimental Variations)

When the proportions of the components of the agglomerates of the previous examples, the proportions of the components of the detergent compositions, the concentrations of the detergent compositions and additives in the wash water, and the molar proportions of cationic and anionic surfactants to form the complex are varied ±10%, ±20%, and ±30% in the experiments previously reported, while being kept within the ranges given in the specification, similar good results for the invented agglomerates are obtainable. Such is also the case when the temperatures and concentrations are similarly varied but maintained within the ranges specified.

The invention has been described in conjunction with descriptions, illustrations and working examples thereof but it is not to be limited to these because it is evident that one of skill in the art, with the present specification before him, will be able to utilize substitutes and equivalents without departing from the invention.

What is claimed is:

1. A fabric softening and antistatic particulate wash cycle additive, for use in conjunction with anionic detergent(s) in wash waters of automatic washing machines, to wash, soften and render antistatic laundry washed in such machines and subsequently dried in an automatic laundry dryer, which comprises about 10 parts by weight of a complex of a cationic surfactant and an anionic surfactant, in which complex the molar proportion of cationic to anionic moieties is in the range of about 1:1 to 1:1.5, and 1 to 80 parts by weight of bentonite.

2. A wash cycle additive according to claim 1 wherein the cationic surfactant is a quaternary ammonium salt or an imidazolinium salt, or a mixture thereof, the anionic surfactant is a sulfonate, sulfate or a carboxylate, or a mixture thereof, the molar proportion of cationic surfactant to anionic surfactant in the complex is about 1:1, and the proportion of cationic/anionic complex to bentonite is about 10 parts by weight of such complex to 2 to 30 parts by weight of bentonite.

3. A wash cycle additive according to claim 2 wherein the bentonite is of particle sizes less than 74 microns in diameter and the particles of cationic/anionic complex and bentonite are agglomerates of bentonite particles held together by said complex, which agglomerates are less than 210 microns in minor diameter.

4. A wash cycle additive according to claim 3 wherein the quaternary ammonium salt is a quaternary ammonium chloride, the imidazolinium salt is a chloride or lower alkyl sulfate, the anionic surfactant is a higher alkylbenzene sulfonate, higher fatty alcohol sulfate, ethoxylated higher fatty alcohol sulfate of 1 to 30 moles of ethylene oxide per mole, or a mixture thereof, the proportion of cationic/anionic complex to bentonite is in the range of 10 parts by weight of anionic/cationic complex to 3 to 15 parts by weight of bentonite, the bentonite is of particle sizes substantially all of which are in the range of 37 to 74 microns in minor diameters, and the agglomerate of cationic/anionic complex and bentonite is of particle sizes substantially all of which are in the range of 105 to 210 microns, in minor diameters.

5. A wash cycle additive according to claim 4 comprising an agglomerate of 10 parts of a complex of sodium linear tridecylbenzene sulfonate and dihydrogenated tallow-alkyl dimethyl ammonium chloride, in equimolar ratio, with 8 to 12 parts by weight of bentonite, which agglomerate is of particle sizes such that substantially all pass through a No. 80 sieve, U.S. Sieve Series.

6. A wash cycle additive according to claim 5 which contains from 0.5 to 10 parts by weight of an emulsifying agent for the cationic/anionic complex.

7. A process for manufacturing the wash cycle additive of claim 1 which comprises mixing bentonite powder and spraying onto the surfaces of such bentonite powder, while continuing mixing thereof, a melt, solution, emulsion or dispersion of a complex of cationic and anionic surfactants, wherein the molar proportion of cationic to anionic moieties in the complex is in the range of about 1:1 to 1:1.5, and continuing mixing thereafter until an agglomerate of bentonite and the complex is formed which is of particle sizes less than 250 microns in diameter.

8. A process according to claim 7 wherein the complex sprayed onto the bentonite is in solution or emulsion form, and the proportions are about 10 parts by weight of such complex to 2 to 30 parts by weight of bentonite.

9. A process according to claim 8 wherein the cationic surfactant of the complex is a quaternary ammonium salt or an imidazolinium salt, or a mixture thereof, the anionic surfactant of the complex is a sulfonate, sulfate or carboxylate, or a mixture thereof, the molar proportion of cationic surfactant to anionic surfactant in the complex is about 1:1, and the cationic/anionic complex is in aqueous solution or emulsion form when sprayed onto the surfaces of the bentonite powder.

10. A process according to claim 9 wherein the quaternary ammonium salt is a quaternary ammonium chloride, the imidazolinium salt is a chloride or lower alkyl sulfate, the anionic surfactant is a higher alkylbenzene sulfonate, higher fatty alcohol sulfate, ethoxylated higher fatty alcohol sulfate of 1 to 30 moles of ethylene oxide per mole, or a mixture thereof, the proportion of cationic/anionic complex to bentonite is in the range of 10 parts by weight of anionic/cationic complex to 3 to 15 parts by weight of bentonite, the bentonite is of particle sizes substantially all of which are in the range of 37 to 74 microns in minor diameters, the agglomerate is dried to a moisture content less than 10%, when it is of a moisture content of 10% or more after formation thereof, and oversized and/or undersized particles are removed from the agglomerate made, so that substantially all of the particles thereof are in the range of 105 to 210 microns, in minor diameters.

11. A process according to claim 10 wherein the agglomerate is of 10 parts of a complex of sodium linear tridecylbenzene sulfonate and dihydrogenated tallowalkyl dimethyl ammonium chloride, in equimolar ratio, with 8 to 12 parts by weight of bentonite, and the agglomerate is screened or otherwise classified so that substantially all particles thereof will pass through a No. 80 sieve, U.S. Sieve Series.

12. A process for simultaneously washing laundry and treating it to soften it and make it antistatic, which comprises washing the laundry in wash water at a temperature in the range of 30° to 95° C., with a built synthetic anionic organic detergent composition which comprises 5 to 35% of synthetic anionic organic detergent, 10 to 80% of builder for such anionic detergent and 0 to 50% of filler salt, which detergent composition is present in the wash water at a concentration in the range of 0.05 to 0.5%, in the presence of 0.01 to 0.1% of the particulate wash cycle additive of claim 1, in the wash water, rinsing the washed laundry, and drying it.

13. A process according to claim 12 wherein the wash water is in an automatic washing machine and its temperature is in the range of 30° to 60° C., the synthetic anionic organic detergent of the detergent composition is selected from the group consisting of higher fatty alcohol sulfates, higher alkylbenzene sulfonates, sulfated ethoxylated higher fatty alcohols, olefin sulfonates, paraffin sulfonates, monoglyceride sulfates, and mixtures thereof, the builder is selected from the group consisting of polyphosphates, carbonates, bicarbonates, borates, silicates, zeolites and mixtures thereof, and the filler salt is sodium sulfate, the antistatic and fabric softening wash cycle laundry additive is comprised of a complex of a cationic surfactant which is a quaternary ammonium salt or an imidazolinium salt or a mixture thereof, and an anionic surfactant, which is a sulfonate, sulfate or carboxylate, or a mixture thereof, and bentonite, with the proportion of complex to bentonite being in the range of 10:1 to 10:80, and the drying is in an automatic laundry dryer.

14. A process according to claim 13 wherein the temperature of the wash water is in the range of 35° to 50° C., the synthetic anionic organic detergent of the detergent composition is sodium linear higher alkylbenzene sulfonate, sodium higher fatty alcohol sulfate, sodium higher fatty alcohol ethoxylate sulfate, or a mixture thereof, the builder is sodium tripolyphosphate, sodium pyrophosphate, sodium carbonate, sodium bicarbonate, sodium silicate, sodium borate, or a mixture thereof, the proportions of synthetic anionic organic detergent, builder and filler salt are in the ranges of 15 to 30%, 25 to 70%, and 0 to 40%, respectively, the antistatic and fabric softening wash cycle laundry additive is an agglomerate of a complex of about equimolar proportions of a quaternary ammonium salt cationic surfactant and a higher alkylbenzene sulfonate anionic surfactant detergent, with bentonite of particle sizes substantially all of which are in the range of 37 to 74 microns, in minor diameters, with the agglomerate being of particle sizes substantially all of which are in the range of 105 to 210 microns, in minor diameters.

15. A process according to claim 14 wherein the agglomerate comprises 10 parts of surfactant complex of equimolar proportions of sodium linear tridecylbenzene sulfonate and dihydrogenated tallowalkyl dimethyl ammonium chloride with 8 to 12 parts by weight of bentonite, the agglomerate is of particle sizes such that substantially all pass through a No. 80 sieve, U.S. Sieve Series, and the concentrations of built detergent composition and of fabric softening and antistatic wash cycle additive in the wash water are in the ranges of 0.1 to 0.2% and 0.01 to 0.04%, respectively.

16. A wash cycle additive according to claim 1 wherein the cationic/anionic complex is in a coating on particles of the bentonite and the particle size of the coated particles is less than 250 microns in diameter.

17. A wash cycle additive according to claim 16 which contains 0.5 to 10 parts by weight of an emulsifying agent for the cationic/anionic complex.

18. A wash cycle additive according to claim 17 wherein the proportion of emulsifying agent for the cationic/anionic complex is 2 to 5 parts by weight per 10 parts by weight of the complex, and the emulsifier is selected from the group consisting of ethoxylated higher alkylamines in which the alkyl is of 12 to 18 carbon atoms and in which 10 to 50 moles of ethylene oxide are present per mole, ethoxylated higher alcohols in which the alcohol is of 12 to 18 carbon atoms and which contain 3 to 20 moles of ethylene oxide per mole, and higher fatty acid complexes of the ethoxylated higher alkylamines, and mixtures thereof.

* * * * *